US007293663B2

(12) United States Patent
Lavery, Jr.

(10) Patent No.: US 7,293,663 B2
(45) Date of Patent: Nov. 13, 2007

(54) SELF-ADVANCING LITERATURE DISPLAY RACK

(75) Inventor: Anthony J Lavery, Jr., Delran, NJ (US)

(73) Assignee: United Video Properties, Inc., Los Angeles, CA (US)

( * ) Notice: Subject to any disclaimer, the term of this patent is extended or adjusted under 35 U.S.C. 154(b) by 559 days.

(21) Appl. No.: 10/748,823

(22) Filed: Dec. 29, 2003

(65) Prior Publication Data

US 2005/0178789 A1 Aug. 18, 2005

(51) Int. Cl.
*A47F 1/04* (2006.01)

(52) U.S. Cl. ..... 211/59.3; 211/49.1

(58) Field of Classification Search ..... 211/59.3, 211/59.2, 49.1, 51, 184; 312/61, 71; 206/817
See application file for complete search history.

(56) References Cited

U.S. PATENT DOCUMENTS 4,836,390 A * 6/1989 Polvere ..... 211/59.3
4,901,869 A * 2/1990 Hawkinson et al. ..... 211/59.3
5,027,957 A * 7/1991 Skalski ..... 211/59.3
5,992,652 A * 11/1999 Springs ..... 211/59.3
6,409,027 B1 * 6/2002 Chang et al. ..... 211/59.3
6,955,269 B2 * 10/2005 Menz ..... 211/59.3
2004/0065631 A1 * 4/2004 Nagel ..... 211/59.3

* cited by examiner

*Primary Examiner*—Jennifer E. Novosad
(74) *Attorney, Agent, or Firm*—Ropes & Gray LLP; Chia-Hao La

(57) ABSTRACT

Improved apparatus and methods for increasing the utility and attractiveness of a literature display are provided. The improved apparatus include a literature rack that automatically advances the remaining copies of literature to the front of the literature rack when copies of literature are removed from the rack. Further, a sloped ramp may be provided to prevent the copies of literature from flopping forward and a lifting portion may be provided to lift the front-most copy of literature above the remaining copies. Multiple energy storage devices may be used in parallel to power the self-advancing feature and may possess reduced-friction properties. Additional signage cards may also be provided to denote that all copies have been purchased from the rack and to provide further space for advertisements or information. Additionally, all of these improved functionalities may be achieved by modifying a pre-existing traditional literature rack with a rack insert possessing the improved apparatus.

7 Claims, 6 Drawing Sheets

SELF-ADVANCING LITERATURE DISPLAY RACK

BACKGROUND OF THE INVENTION

The present invention relates generally to apparatus and methods for displaying copies of literature in a literature rack. More specifically, the present invention is directed toward providing improved apparatus and methods for increasing the utility and attractiveness of a literature display.

Literature such as magazines, books, brochures, etc. need to be displayed to consumers so as to attract positive attention to the literature. In certain settings, such as a supermarket checkout aisle, where a large number of literature displays compete for the consumer's attention, the need to attractively display literature is even more pronounced.

Traditionally, multiple copies of literature are simultaneously placed in a literature rack for display to the consumer. The multiple copies of literature support each other in a full literature rack so that the copies stand up straight and the cover of the front copy is easily viewed by the consumer. However, this traditional method of displaying literature has many drawbacks.

In one instance, when a large percentage of the copies of literature in a rack has been removed or purchased, the remaining copies of literature tend to flop forward or backward in the rack. This causes the cover of the front-most copy to become obscured or difficult to read. In addition, such flopping of the literature causes the literature display to have an untidy and unattractive appearance.

In another instance, a traditional literature rack allows the encroachment of other types of literature into a rack designated for a particular type of literature. Such encroachment is most common when a consumer picks up a copy of another type of literature, browses its contents, and decides against purchasing the literature. These unpurchased copies of literature are often haphazardly placed back into racks designated for other types of literature. By placing a copy of another type of literature in front of the designated type of literature in a rack, the designated type of literature may be completely obscured from viewing by other interested consumers. Other interested consumers may not be provided with an opportunity to be enticed by the front cover of the literature and may conclude that the literature is not available at the particular retail location.

In another instance, remaining copies of literature in a traditional literature rack may have a tendency to flop forward when copies are removed from the rack. Forward flopping of the literature is typically more undesirable because it may make the front cover of the literature more difficult to read than in an instance where the literature flops backward in the rack. Further, in many traditional literature racks, a front lip portion of the literature rack obscures a lower portion of the front cover of the literature being displayed. Such an instance may cause an attractive portion of the literature cover to be unviewable by a consumer.

In another instance, "sold out" signs that are often placed in traditional literature racks also tend to flop and become obscured. Further, traditional removable "sold out" signs may not denote what type of literature was originally placed in the literature rack and may become separated from the literature rack. Still further, traditional literature racks do not provide further opportunities for enticing a consumer with additional signage configured to remain with a designated literature display.

In view of the foregoing, it is an object of the present invention to provide an improved method for displaying literature in a literature rack with a self-advancing feature.

It is another object of the present invention to provide an improved literature rack that tilts the copies of literature slightly backward to prevent forward flopping.

It is another object of the present invention to provide an improved literature rack that lifts a front-most copy of the literature above the remaining copies.

It is another object of the present invention to provide an improved literature rack that uses multiple, parallel energy storage devices and reduced-friction features to provide a smoother mechanism for the self-advancing feature.

It is another object of the present invention to provide an improved literature rack that allows for a maximum number of copies to be displayed in the literature rack.

It is another object of the present invention to provide an improved literature rack that clearly denotes that all copies have been purchased from the literature rack.

It is another object of the present invention to provide an improved literature rack that provides additional opportunities for advertising and information display.

It is another objective of the present invention to provide a modifying rack insert that provides all the above improved functionalities to a pre-existing literature rack.

SUMMARY OF THE INVENTION

These and other objects of the invention are accomplished in accordance with the principles of the present invention by providing a literature rack that automatically advances the remaining copies of literature to the front of the literature rack when the front-most copy of literature is removed from the rack.

In one embodiment, a spring loaded back plate is provided in the literature rack that is resiliently biased to advance toward the front of the literature rack. The back plate may be pushed to the back of the literature rack to load the springs and to allow the copies of literature to be placed in front of the back plate in the rack.

In another embodiment, the spring loaded back plate may be part of a rack insert used to modify a pre-existing traditional literature rack.

In one aspect of the present invention, the rack insert may be custom fit for the pre-existing literature rack and securely installed within the rack by an interference bar that engages a portion of the literature rack.

In one aspect of the present invention, a sloped ramp may be provided in the literature rack that tilts the copies of literature back from the front of the literature rack in order to prevent the copies from flopping forward under the forward advancing force of the back plate.

In one aspect of the present invention, a lifting portion is disposed at the front of the literature rack to lift the front-most copy of literature above the remaining copies. This enables the front-most copy to be more easily removed from the rack by a consumer.

In one aspect of the present invention, multiple energy storage devices are used in parallel to provide the self-advancing force of the back plate. The use of multiple energy storage devices in parallel moves the copies of literature forward more evenly and distributes the load required to advance the copies.

In one aspect of the present invention, an anti-friction coating may be applied to the surface of constant force springs used to advance the back plate to make the springs glide against the back plate in a smoother manner and to ensure a smoother travel of the back plate rearward and forward in the literature rack.

In one aspect of the present invention, openings are cut on the supporting plate that supports the back plate to allow each constant force spring to travel through the plane of the supporting plate in a rearmost position. This allows the back plate to be pushed further to the back of the literature rack and allows the maximum number of copies to be accommodated by the literature rack.

In one aspect of the present invention, a signage card may be provided on the back plate that is advanced to the front of the literature rack when all copies have been removed from the rack. The signage card may denote that all copies have been purchased and that more copies should be placed in the rack.

In one aspect of the present invention, a double sided signage card may be provided on top of the back plate that is designed to be seen over the copies of literature. The signage card may be used to identify the type of literature being displayed in the rack or to provide further advertisements or information for the literature.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE PREFERRED EMBODIMENTS

Figure 1:
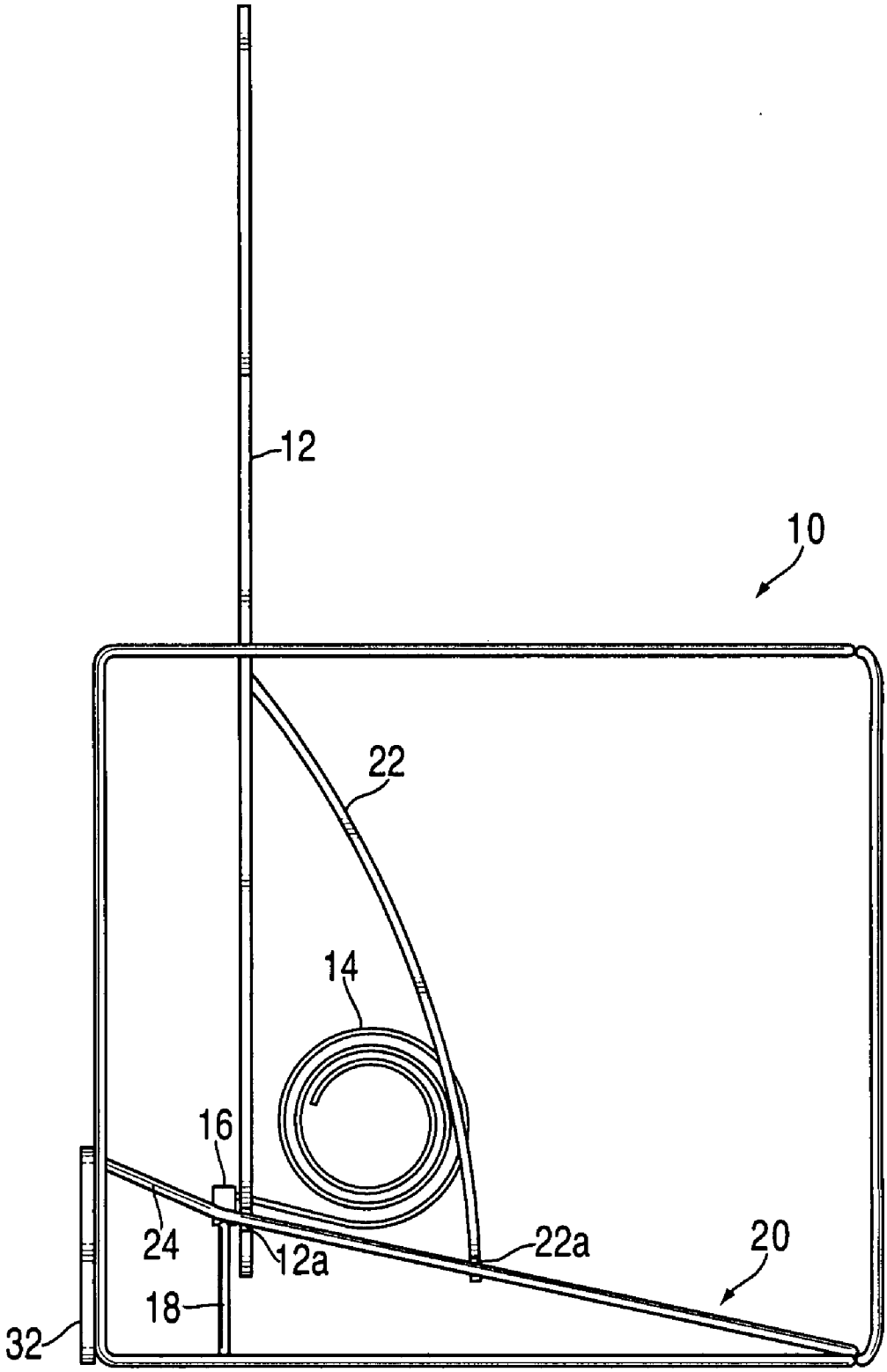
FIG. 1 is a side elevation view of the empty literature rack in accordance with one embodiment of the present invention.

FIG. 1 shows the side elevation view of literature rack 10 in an empty state. As shown in FIG. 1, back plate 12 is at its forward most empty position. Constant force spring 14, which may be formed by winding a flat strip of metallic or other suitable material into an annular shape, is disposed behind back plate 12. One end of constant force spring 14, which may be one free end of the flat strip of material making up constant force spring 14, is fixedly attached to attachment clip 16. As will be described in more detail later, this disposition of constant force spring 14 allows it to unwind when back plate 12 is pushed toward the rear of literature rack 10.

Figure 6:
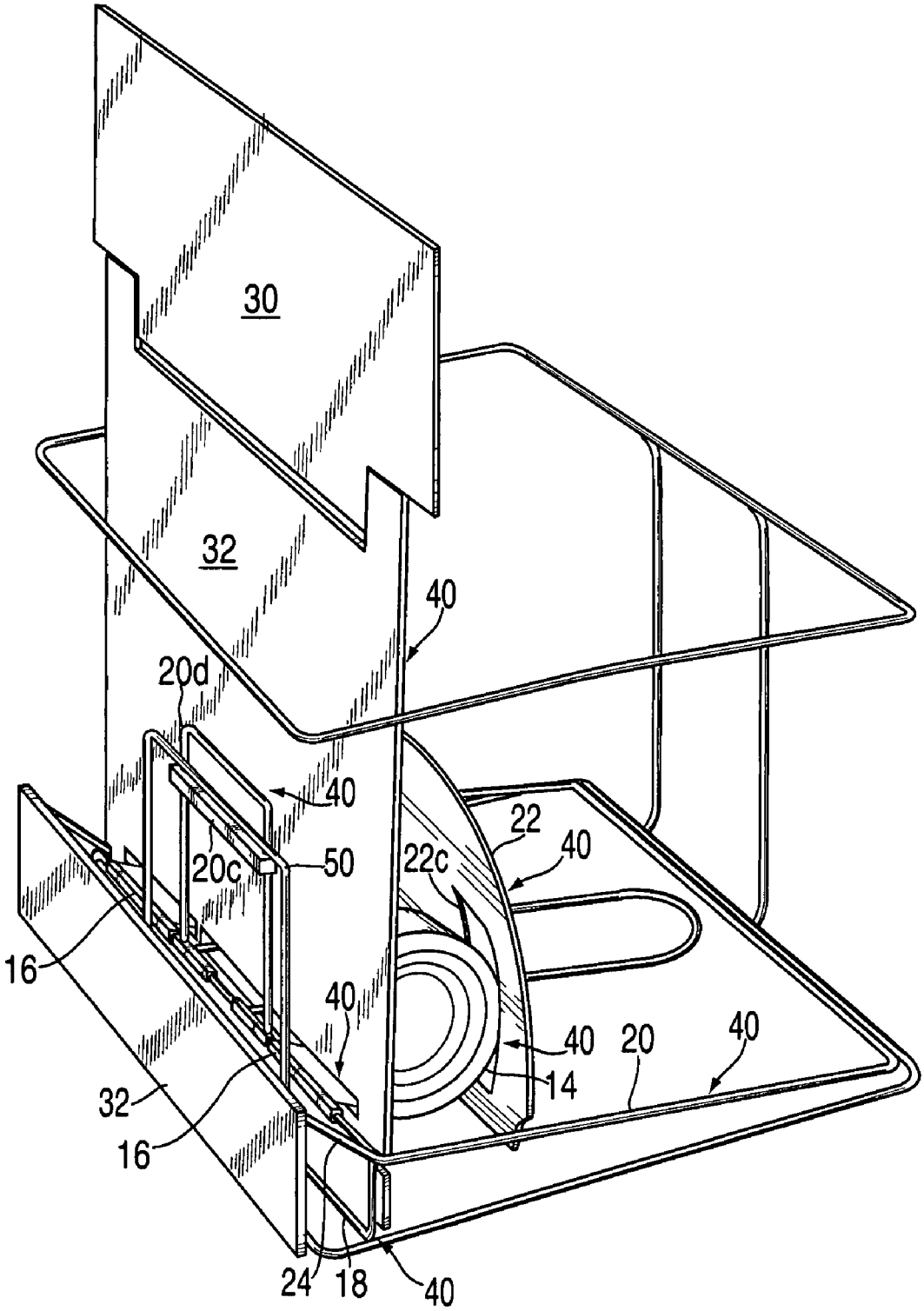
FIG. 6 is a front corner perspective view of the empty literature rack in accordance with one embodiment of the present invention.

Attachment clip 16 may be disposed on front leg 18, which serves to lift the front portion of ramp 20 to give the ramp a desired backward leaning slope. Note that attachment clip 16 may also serve as the front-most mechanical stop for back plate 12. Further, attachment clip 16 may be allowed to rotate about its attachment point on front leg 18 as constant force spring 14 is wound and unwound. By allowing the rotation of attachment clip 16, a smoother gliding action for back plate 12 is achieved. Attachment clips 16 are also illustrated in FIG. 6, which shows the lateral positioning of clips 16 on front leg 18.

Support plate 22 is disposed to the rear of back plate 12 and engages the back plate at a position that substantially half way up the rear of the back plate. Support plate 22 is slideably engaged with ramp 20 at points 22*a*. Further, back plate 12 is also slideably engaged with ramp 20 at points 12*a*. Generally, support plate 22 forms a triangle with ramp 20 and back plate 12 that frames constant force spring 14. Lifting portion 24 is disposed at the front-most end of ramp 20 and is configured to lift a front-most copy of the literature above the rest of the copies to provide convenient removal by a consumer. Note that lifting portion 24 provides an additional lifting increment in addition to the normal backward leaning slope of ramp 20, of which it is an extension.

Figure 2:
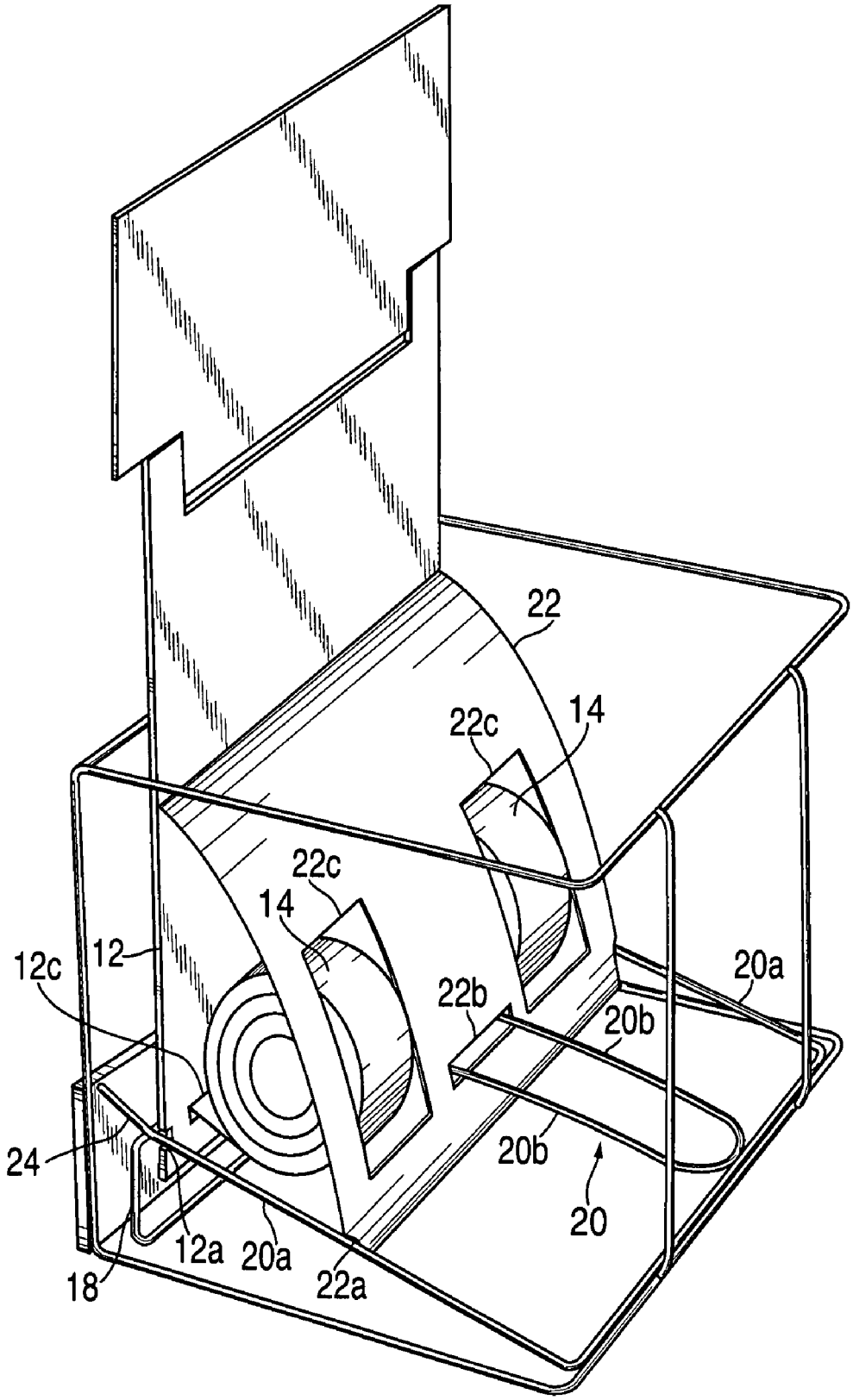
FIG. 2 is a rear corner perspective view of the empty literature rack in accordance with one embodiment of the present invention.

FIG. 2 shows a rear corner perspective view of literature rack 10 in its empty state. As shown in FIG. 2, points 12*a* and 22*a* of back plate 12 and support plate 22 engage outer bars 20*a* of ramp 20. These engagement points may be cut-out notches that rest on bars 20*a*. In order to securely attach support plate 22 to ramp 20, cut-out portion 22*b* may be provided that surrounds inner bars 20*b* of ramp 20 to allow support plate 22 to securely glide upon inner bars 20*b*. Similarly, a corresponding cut-out portion (not shown) is provided on back plate 12 to allow the back plate to securely glide upon inner bars 20*b*. Therefore, in cooperation with engagement points 12*a* and 22*a*, the previously described cut-out portions enable the combined apparatus of back plate 12 and support plate 22 to securely glide back and forth on ramp 20.

As further illustrated in FIG. 2, cut-out portions 22*c* are provided on support plate 22. As will be further described in the following, cut-out portions 22*c* allow constant force springs 14 to pass through the plane of support plate 22 in their most extended position to allow for more capacity in literature rack 10. Slots 12*c* are also provided in back plate 12 to allow the free ends of constant force springs 14 to pass through the back plate and attach to clips 16. FIG. 2 also shows that multiple constant force springs 14 may be used in parallel to power the self-advancing feature of literature rack 10. It should be understood that other appropriate energy storage devices such as linear springs, coil springs, leaf springs, or hydraulic devices may be used to power the self-advancing feature. The use of multiple energy storage devices in parallel has the advantage of providing a more even gliding action for back plate 12 on ramp 20 and may reduce the individual load required of each energy storage device (thereby saving space in the apparatus).

Figure 3:
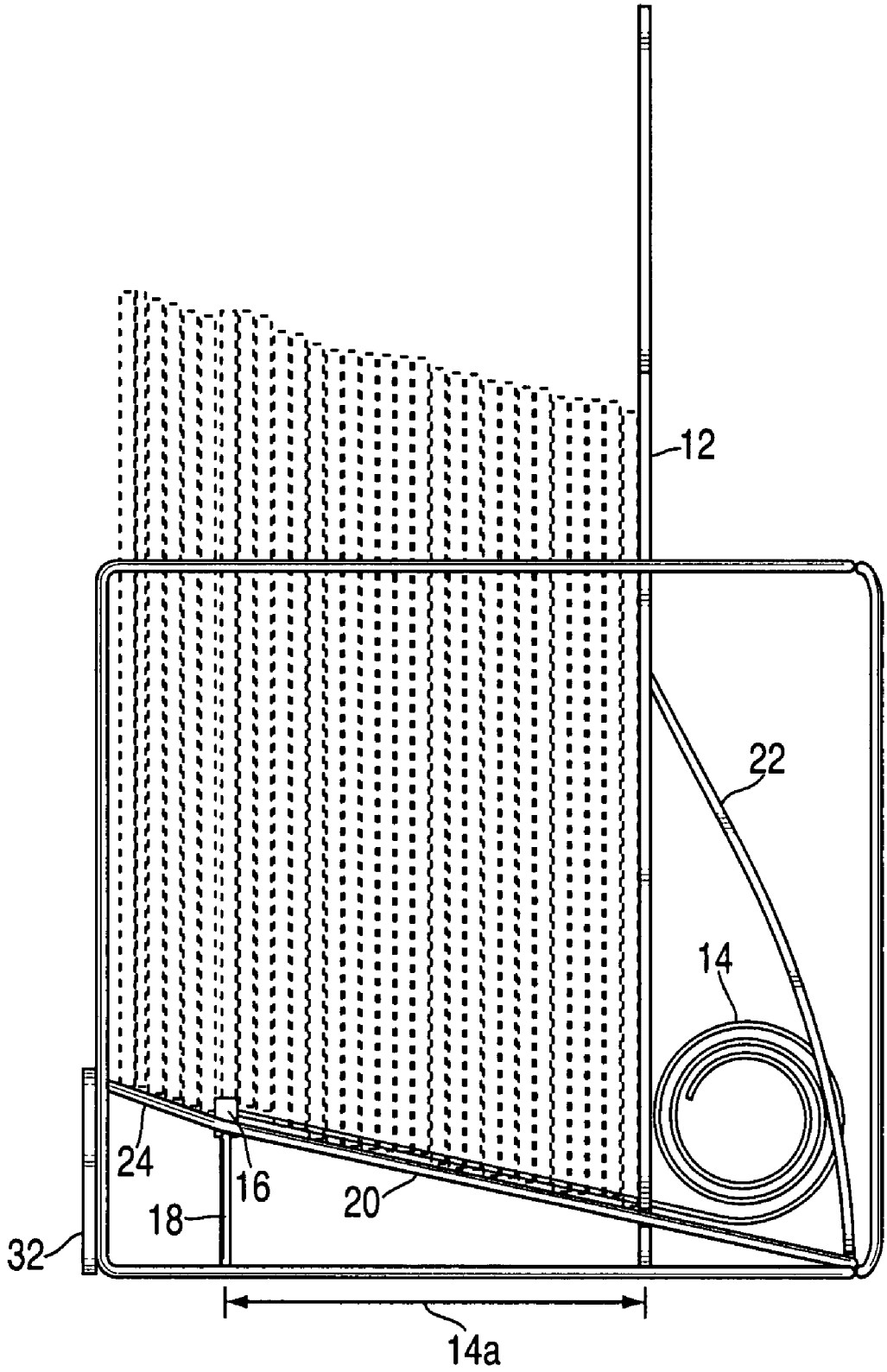
FIG. 3 is a side elevation view of the full literature rack in accordance with one embodiment of the present invention.

FIG. 3 shows a side elevation view of literature rack 10 when the rack is filled to capacity with copies of literature. As shown in FIG. 3, constant force spring 14 is uncoiled to its most extended position when the rack is filled. Spring extension 14*a* represents the distance back plate 12 has been pushed to the rear of literature rack 10 to allow for the insertion of a full capacity of literature. In the extended position, constant force spring 14 is exerting a spring force upon back plate 12 toward the front of the literature rack. Further, note that in its most extended position, constant force spring 14 passes through cutouts 22*c* in support plate 22 to allow back plate 12 to reach a rearmost position in the literature rack.

Figure 4:
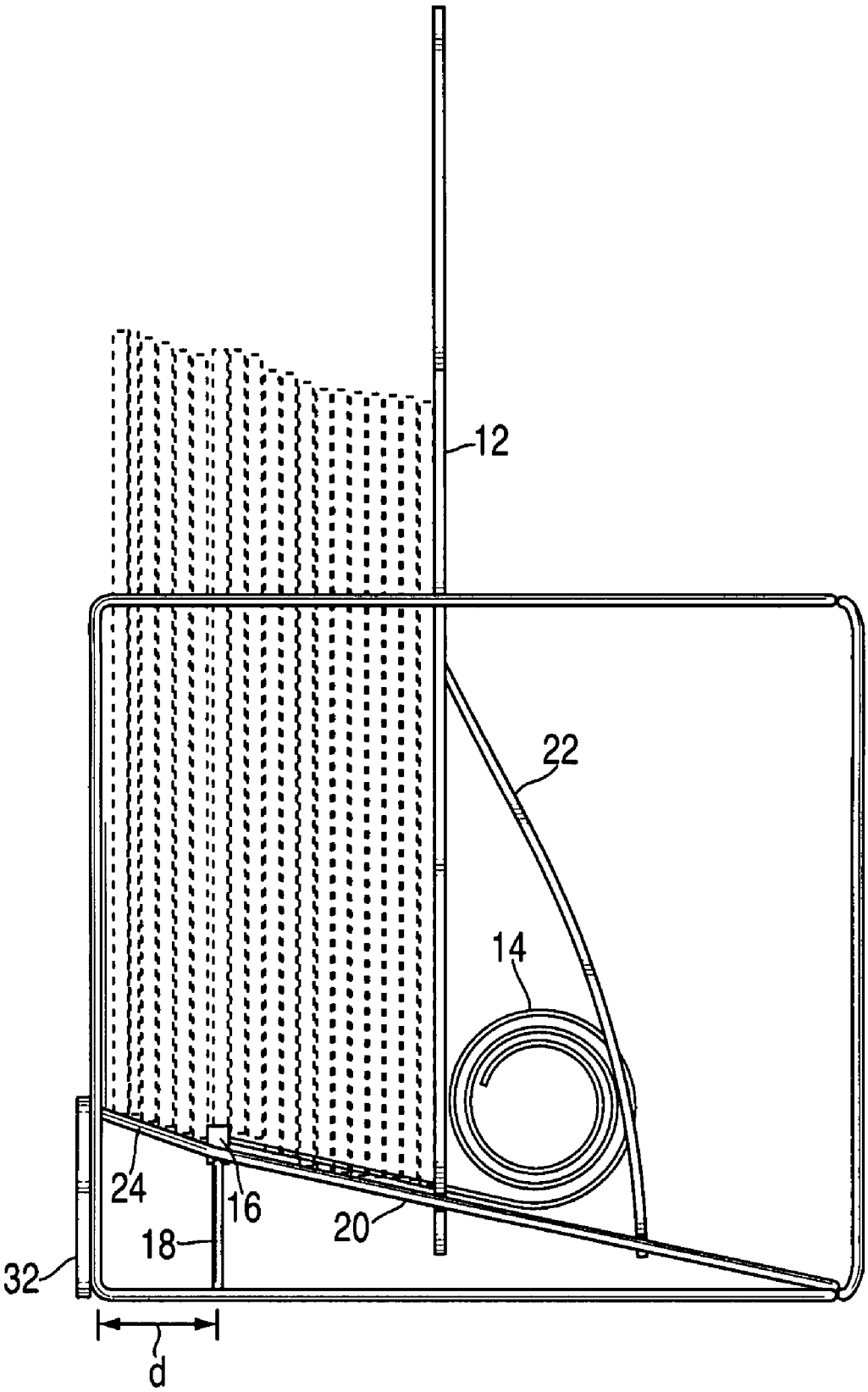
FIG. 4 is a side elevation view of the half-full literature rack in accordance with one embodiment of the present invention.

FIG. 4 shows a side elevation view of a half full literature rack. As shown in FIG. 4, when copies of the displayed literature are removed from the rack, back plate 12 will accordingly advance forward under the spring force exerted by constant force spring 14 and press the copies forward against the front of literature rack 10. In this way, copies of the literature in rack 10 are securely pressed to the front of the literature rack regardless of the number of remaining copies in the rack. Further, the copies in literature rack 10 are fully supported by back plate 12, which may have substantially the same dimensions as copies of the displayed literature. This allows the remaining copies of literature to stand upright with the cover of the front-most copy being fully visible to the consumer.

As illustrated by FIGS. 3 and 4, constant force springs 14 are uncoiled (or pushed into extension) by the rearward action of back plate 12, which applies a force on the constant force springs. Similarly, constant force springs 14 apply a force on the rear face of back plate 12 when they coil back onto themselves to push the back plate forward. This action causes the material of torsion springs 14 to rub against the rear face of back plate 12. Therefore, to minimize the friction between back plate 12 and constant force springs 14, anti-friction coating (e.g., Teflon) may be applied to the surfaces of constant force springs 14, back plate 12, or both. Using the anti-friction coating results in a reduction in frictional forces and enables back plate 12 to have a smoother and more even gliding action on ramp 20.

Another advantage of the self-advancing feature of literature rack 10 is the reduction in instances of encroachment by other types of literature. As previously noted, traditional literature racks allow more room to become available in the rack as copies of literature are removed. This empty room invites instances of incidental encroachment, where other types of literature are placed in the literature rack intended for one type of literature. By providing a self-advancing literature rack that constantly provides a forward force on the remaining copies of literature, it becomes more burdensome to encroach on the literature rack. Consumers that are tempted to casually discard a copy of literature may be less likely to push back the self-advancing apparatus in order to do so, and may instead place the copy in another area or back into its original rack.

As illustrated by FIG. 4, the backward leaning slope of ramp 20 elevates the copies as they are pressed forward from the back of literature rack 10 by back plate 12. At the forward most portion of ramp 20, lifting portion 24 lifts the front-most copy of the literature an additional increment above the remaining copies to the rear of the literature rack. This additional increment of elevation allows the consumer to more easily procure the front copy of literature from the rack. Lateral dimension d of lifting portion 24 may also be optimized for the thickness of the literature being displayed so as to ensure that only a single copy is lifted upward from the rest. In addition, the general backward leaning slope of ramp 20 may prevent the copies of literature from leaning forward under the spring force asserted by back plate 12 and constant force springs 14. Forward leaning of the copies may occur when back plate 12 is taller than a front railing of literature rack 10 and the force from springs 14 cause the copies to lean slightly forward over the front railing. Further, as shown in FIGS. 3 and 4, ramp 20 and lifting portion 24 may cooperate to lift the front-most copy of the displayed literature completely above identification bar 32 that may normally obscure a lower portion of the front cover.

Figure 5:
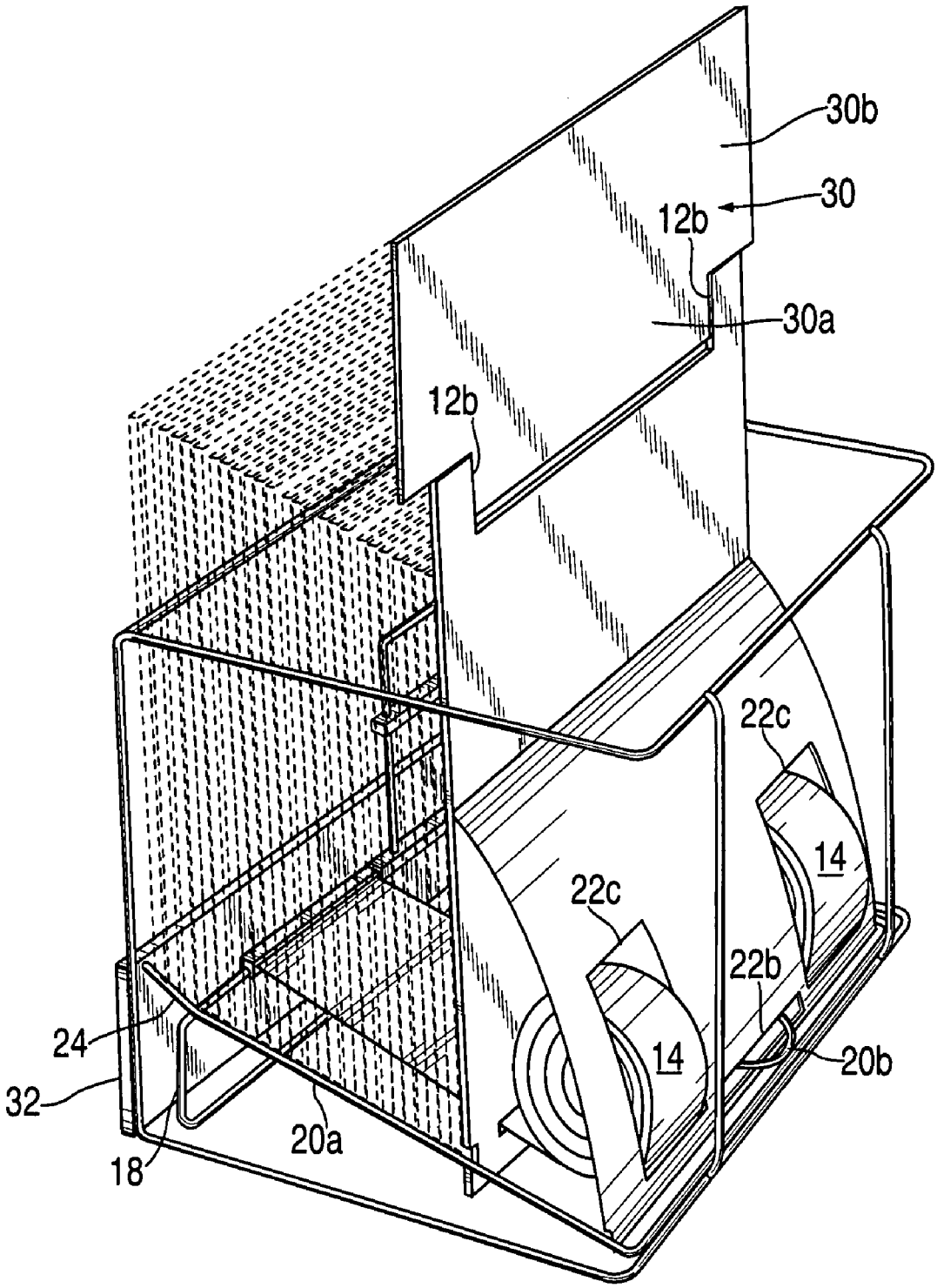
FIG. 5 is a rear corner perspective view of the full literature rack in accordance with one embodiment of the present invention.

FIG. 5 shows a full literature rack from a rear corner perspective view. FIG. 5 further illustrates how constant force springs 14 extend through cut-outs 22*c* in the supporting plate to allow for maximum rearward deflection of back plate 12 in the literature rack. FIG. 5 also shows insertion grooves 12*b* which may be located on the rear face of back plate 12. Insertion grooves 12*b* may be configured to receive signage card 30, which may have a narrower portion 30*a* adapted for insertion into grooves 12*b*. It should be understood that any other suitable method may be used to removably engage signage card 30 to back plate 12, such as the use of a clip incorporated into back plate 12. Alternatively, signage card 30 may be permanently incorporated into back plate 12.

As further illustrated by FIG. 5, signage card 30 may be disposed over the top of back plate 12 so that it may be viewed over the top of the copies of literature inserted into the rack. Top portion 30*b* of the signage card may also be wider than engagement portion 30*a*, and may provide a larger surface for displaying identifying information or advertisements. Signage card 30 may have information or graphics printed on both the front and rear sides such that any information or graphics printed on card 30 may be viewable from both sides. This may be an advantage, for example, in a supermarket checkout aisle display, where the rear face of the card may be viewed by consumers in an adjoining checkout aisle. Information that may be suitable for printing on signage card 30 may include identifying information on the literature displayed beneath card 30, information on the contents of the latest issue of the literature being displayed, price information on the literature being displayed, or other advertising information.

FIG. 6 shows an empty literature rack from a front corner perspective view. FIG. 6 further illustrates how signage card 30 may be viewed from the front of the literature rack above back plate 12 and over any inserted copies of literature. As shown in FIG. 6, when all copies of the literature being displayed in rack 10 have been removed, back plate 12 is advanced to its forward most position and the front face of back plate 12 becomes fully visible. The front face of back plate 12 may include signage card 32. Signage card 32 include printed information that identifies the type of literature that was being displayed in the literature rack and may also present the consumer with other information. For example, signage card 32 may include a "sold out" label and instructions to the merchant on how to restock the literature with the self-advancing rack. This may prompt the consumer to request further copies of the sold out literature and may prompt the merchant to more expediently restock the sold out literature.

In one embodiment of the present invention, the apparatus for automatically advancing the copies of literature forward (including back plate 12, supporting plate 22, constant force springs 14, attachment clips 16) and the accompanying ramp and lifting apparatus (ramp 20 and lifting portion 24) may be formed as a rack insert. By using a modifying rack insert, an advantage may be had in modifying pre-existing literature racks with the functionality of an improved literature rack without discarding the existing racks. As shown in FIG. 6, front support bars 20*d*, which are vertical extensions of inside ramp bars 20*b*, possess an interference bar 20*c*. Interference bar 20*c* may be used to engage a front portion 50 of the pre-existing literature rack in an interference fit to secure rack insert 40 in the pre-existing literature rack.

An interference fit may be achieved if the rack insert is custom fit so that its dimension from front to back is exactly (or only slightly less than) the space allowed in the pre-existing literature rack. Rack insert 40 may then be inserted into the pre-existing literature rack rearward and downward and pivoted inside the pre-existing literature rack. A downard force may then be applied to the front of rack insert 40. This downward force causes the material of the literature rack and rack insert 40 to resiliently deform slightly and allows interference bar 20*c* to move past front portion 50. Once in place, interference bar 20*c* cooperates with front portion 50 to secure rack insert 40 within the pre-existing literature rack. It should be understood that the use of rack insert 40 has no effect on the functionalities of the previously described improved literature rack, which may also be manufactured with all of the improved apparatus and functionalities in place.

Therefore, improved apparatus and methods for displaying literature in an attractive and commercially efficient manner are provided. It should be understood that the foregoing is merely illustrative of the principles of the present invention and that various modifications can be made by those skilled in the art without departing from the scope and spirit of the invention.

What is claimed is:

1. Apparatus for displaying copies of literature comprising:

a rack configured to store the copies consecutively in the rack such that a front or rear face of each copy is directed toward a front of the rack;

a ramp disposed within the rack and sloping upwards towards the front of the rack;

a self-advancing back plate, disposed within the rack and slideably engaged with the ramp, that is resiliently biased to press the stored copies toward the front of the rack, wherein the back plate is configured to move on the ramp to advance remaining copies toward the front of the rack as each copy is removed from the rack; and an energy storage device that provides the resilient bias of the back plate.

2. The apparatus of claim 1 wherein the energy storage device is a spring.

3. The apparatus of claim 1 wherein multiple energy storage devices are configured in parallel to provide the resilient bias of the back plate.

4. The apparatus of claim 1 further comprising a support plate that engages a rear of the back plate.

5. The apparatus of claim 4 wherein slots are provided on the support plate to allow an extended spring to pass through the support plate.

6. The apparatus of claim 1 wherein the back plate is provided with slots that enclose the ramp to provide secure movement of the back plate.

7. The apparatus of claim 1 wherein the back plate and the energy storage device are disposed on a rack insert that may be installed into the rack.

* * * * *